US006719542B2

(12) United States Patent
Shibuya

(10) Patent No.: US 6,719,542 B2
(45) Date of Patent: Apr. 13, 2004

(54) PUMP FOR PRINTING PRESS

(75) Inventor: Kazuaki Shibuya, Tokyo (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 18 days.

(21) Appl. No.: 10/160,055

(22) Filed: Jun. 4, 2002

(65) Prior Publication Data

US 2003/0068244 A1 Apr. 10, 2003

(30) Foreign Application Priority Data

Oct. 5, 2001 (JP) ..... P2001-310261

(51) Int. Cl.[7] ..... F04B 39/10; F04B 7/04

(52) U.S. Cl. ..... 417/490; 417/498; 418/206.4; 101/366

(58) Field of Search ..... 417/490, 492, 417/498; 418/193, 204; 101/366, 365, 363, 207, 208, 209, 210

(56) References Cited

U.S. PATENT DOCUMENTS 3,168,872 A * 2/1965 Pinkerton ..... 103/157
5,024,587 A * 6/1991 Maurer ..... 417/48
5,168,807 A * 12/1992 Elia et al. ..... 101/366
5,526,745 A * 6/1996 Uera ..... 101/366

FOREIGN PATENT DOCUMENTS

JP 07-323520 * 12/1995
JP 2864447 12/1998

* cited by examiner

*Primary Examiner*—Justine R. Yu
*Assistant Examiner*—Hai L. Liu
(74) *Attorney, Agent, or Firm*—Westerman, Hattori, Daniels & Adrian, LLP

(57) ABSTRACT

A pump for a printing press includes a plunger within a cylinder to be rotatable and reciprocatable and having a cutaway portion at its distal end, and a constant-speed motor for rotating and reciprocating the plunger. The plunger and the output shaft of the motor are radially offset relative to each other and inclined with respect to each other. The output shaft of the motor is coupled to the plunger via a transmission mechanism which includes an arm and a connection member. The arm is connected to, for example, the plunger, and the connection member is connected to, for example, the output shaft of the motor. The arm and the connection member are connected with each other at an eccentric position in such a manner that the arm and the connection member can displace relative to each other in the radial direction and can change the intersecting angle therebetween.

3 Claims, 5 Drawing Sheets

PUMP FOR PRINTING PRESS

BACKGROUND OF THE INVENTION

1. Field of the Invention

The present invention relates to a pump for a printing press which is configured so as to axially reciprocate a plunger, while rotating the same, by means of a motor, to thereby supply ink to an inking unit of the printing press.

2. Description of the Related Art

A conventional pump for an offset printing press is disclosed in, for example, Japanese Patent No. 2864447. In the disclosed pump, a plunger accommodated within a main bore is reciprocated and rotated by a variable-speed motor in such a manner that the plunger undergoes a single cycle of reciprocating motion for each turn; and such operation is repeated in order to supply ink to an inking unit.

As shown in FIG. 8, the conventional pump consists of a body 101, a cylinder 102, a plunger 103, a variable-speed motor 104, and a transmission mechanism 105. The body 101 is formed by a block portion 111 and a hollow housing portion 112 connected to the block portion 111. The cylinder 102 is fitted into a through hole 113 of the block portion 111 in such a manner that its outer end projects from the outer side surface of the block portion 111, and its inner end reaches a hollow space 112*a* formed inside the hollow housing portion 112. The plunger 103 is accommodated within a main bore 120 of the cylinder 102 to be rotatable and receiprocatable along the axial direction. A base end portion of the plunger 103 projects into the hollow space 112*a* of the hollow housing portion 112. The variable-speed motor 104 is attached to an outer wall 112*b* of the hollow housing portion 112 in such a manner that an output shaft 140 of the variable-speed motor 104 projects into the hollow space 112*a* of the hollow housing portion 112. The transmission mechanism 105 is disposed in the hollow space 112*a* in order to connect the output shaft 104 to the plunger 103, to thereby transmit rotation of the output shaft 140 to the plunger 103 while converting the rotational motion of the output shaft 140 to rotation and reciprocative motion of the plunger 103.

The through hole 113 of the block portion 111 for receiving the cylinder 102 is formed to extend from the side of the hollow housing portion 112 toward the outer side surface of the block portion 111, while inclining downward at a certain inclination angle. Accordingly, the cylinder 102 also inclines downward at the same inclination angle. An outer-end opening portion of the main bore 120 of the cylinder 102 is closed by means of a plug. At an axial position which is a predetermined distance away from the outer end of the cylinder 102, an intake hole 121 and a discharge hole 122 are provided in the cylinder 102 at diametrically opposite positions such that the intake hole 121 and the discharge hole 122 penetrate the cylinder 102 upward and downward, respectively, along a common center axis. In other words, the intake hole 121 and the discharge hole 122 are opened to the main bore 120 with a phase difference of 180° therebetween.

A distal-end portion of the plunger 103, which is accommodated within the main bore 120 to be rotatable and receiprocatable along the axial direction, has a cutaway portion 131. The cutaway portion 131 is formed through removal of a portion having a substantially semicircular cross section and extends axially over a predetermined distance from the distal end surface.

Specifically, the cutaway portion 131 has a length such that the base end of the cutaway portion 131 is located on the side toward the open end of the main bore 120 with respect to the intake hole 121 and the discharge hole 122, when the plunger 103 is moved to the deepest point within the main bore 120, as will be described later.

More specifically, the cutaway portion 131 is formed in such a manner that, when the plunger 103 is moved to the deepest point within the main bore 120 in the course of its reciprocating movement, the base end of the cutaway portion 131 is located at a position which is offset toward the open end of the main bore 120 with respect to axial positions at which the intake hole 121 and the discharge hole 122 communicate with the main bore 120, respectively, and a cylindrical surface of the cutaway portion 131 can close the intake hole 121 and the discharge hole 122 simultaneously, and that the distal end of the plunger 103 is located between the plugged end of the main bore 120 and the points at which the intake hole 121 and the discharge hole 122 communicate with the main bore 120, respectively. Therefore, upon rotation of the plunger 103, the intake hole 121 and the discharge hole 122 are closed simultaneously by the cutaway portion 131 at phase angles having an angular difference of 180° therebetween, and only one of the intake hole 121 and the discharge hole 122 is closed by the cutaway portion 131 at other phase angles.

The rotational axis of the plunger 103 and the rotational axis of the output shaft 140 form an angle therebetween; and a tip end portion of the output shaft 140 is connected to the base end portion of the plunger 103 by means of the transmission mechanism 105.

Moreover, fluid passages 114 and 115 communicating with the intake hole 121 and the discharge hole 122, respectively, of the cylinder 102 are formed in the block portion 111.

The fluid passage 114 is connected to an unillustrated ink supply source. The fluid passage 115 is connected to an inking unit of a printing press. Therefore, ink is supplied to the main bore 120 of the cylinder 102 via the intake hole 121; and ink pressurized to a predetermined pressure is fed from the main bore 120 to the inking unit via the discharge hole 122.

The transmission mechanism 105, which connects the output shaft 140 of the variable-speed motor 104 to the plunger 103, includes a connection member 151 and an arm 150. The connection member 151 projects radially from the base end portion of the plunger 103, which projects into the hollow space 112*a*. The arm 150 is attached to the output shaft 140 and has a protrusion which projects toward the plunger 103 at an eccentric position with respect to the rotational axis of the output shaft 140. A spherical bearing 152 is attached to the tip end of the projection of the arm 150, and the tip end portion of the connection member 151 attached to the plunger 103 is fitted into the inner ring of the bearing 152 to be movable along the axis thereof.

The above-described conventional pump for a printing press involves the following problems.

Since the variable-speed motor (hereinafter referred to as the "motor") 104 is disposed in such a manner that the rotational axis of the output shaft 140 of the motor 104 intersects the rotational axis of the plunger 103 at a predetermined intersecting angle, when the output shaft 140 of the motor 104 rotates 180° (a half turn) during a single rotation, the plunger 103 rotates 180° and moves toward the open end of the main bore 120 to thereby take in ink.

When the output shaft 140 rotates a further 180° (the remaining half turn), the plunger 103 rotates another 180° and moves toward the closed end of the main bore 120 to thereby discharge ink. The relationship between angular displacement of the output shaft 140 of the motor 104 and that of the plunger 103 is maintained constant at all times; and the angular displacement of the output shaft 140 for the intake stage of the operation cycle of the plunger 103 is identical with that for the discharge stage of the operation cycle. Therefore, intake and discharge of ink are performed alternately over respective periods of equal length.

Therefore, when the plunger 103 is in the intake stage, supply of ink to the inking unit stops even when a paper surface undergoing printing requires ink. When the plunger 103 enters the discharge stage, an increased amount of ink is discharged in order to compensate for the insufficient supply in the intake stage.

Therefore, a large quantity of ink is supplied at one time to the inking unit, so that the amount of ink supplied from the inking unit to the surface of a printing plate changes greatly when the plunger 103 enters the discharge stage, thereby producing an unevenness in density of ink on the printed paper surface, leading to deteriorated printing quality.

Depending on a matter to be printed on a paper surface, a large amount of ink may be demanded. In such a case, the pump must be operated to perform the discharge operation at a frequency higher than the ordinary frequency, in order to discharge a larger amount of ink within a short period of time. Therefore, a larger amount of ink as compared to that involved in the ordinary case is fed to the discharge passage, and the pressure within the discharge passage increases, with a resultant tendency of increased discharge pressure of ink.

In other words, high pressure is generated within the main bore and the ink discharge passage in the discharge stage, and due to this high pressure, ink is likely to leak from the very small clearance between the main bore 120 and the plunger 103. The leaked ink may adhere to the outer circumferential surface of the portion of the plunger 103 projecting into the hollow space 112*a* and the transmission mechanism and harden there, possibly hindering smooth operation of the pump. Therefore, maintenance work for disassembling and cleaning the pump must be performed frequently.

Further, since the above-mentioned increase in discharge pressure and adhesion of ink increase the load imposed on the pump, a motor of relatively large output torque must be employed in order to cope with the increased load, thereby making it difficult to reduce the size of the pump and increasing consumption of electric power and heat generation.

SUMMARY OF THE INVENTION

The present invention has been accomplished in order to simultaneously solve the problems involved in the conventional techniques, and an object of the present invention is to provide a pump for a printing press which can eliminate unevenness of ink density on a printed paper surface; which suppresses an increase in discharge pressure of ink so as to prevent ink leakage, to thereby facilitate maintenance work; and which can reduce the size of the pump and conserve energy.

The present invention provides a pump for a printing press which includes a cylinder having a main bore which extends along an axis of the cylinder and is closed at one end, and intake and discharge holes which are opened to an inner surface of the cylinder at different circumferential positions. A plunger is fitted into the main bore to be rotatable about the axis and reciprocatable along the axis. The plunger closes the intake and discharge holes simultaneously at certain angular positions and closes only one of the intake and discharge holes at other angular positions. A motor for rotating and reciprocating the plunger is disposed in such a manner that an output shaft of the motor faces a base end portion of the plunger projecting from an open end of the cylinder, that a space is present between the base end portion and the output shaft, and that a rotational axis of the output shaft is radially offset, by a certain eccentricity distance, from a rotational axis of the plunger and forms an angle with the rotational axis of the plunger. A transmission mechanism is disposed in the space and includes a first member fixed to the base end portion of the plunger, and a second member fixed to the output shaft of the motor. The first and second members are connected with each other at an eccentric position in such manner that the first member and the second member can move relative to each other in the radial direction of the output shaft or the plunger and can change an intersecting angle therebetween.

Preferably, the first member is an arm attached to the base end portion of the plunger, and the second member is a connection member attached to the output shaft of the motor; the arm has a projection extending toward the output shaft of the motor at an eccentric position with respect to the rotational axis of the plunger, the projection supporting a spherical bearing; and the connection member radially extends from the output shaft and is slidably received by an inner ring of the spherical bearing, wherein the distance between the eccentric position and the rotational axis of the plunger is greater than the eccentricity distance.

Alternatively, the first member is a connection member attached to the base end portion of the plunger, and the second member is an arm attached to the output shaft of the motor; the arm has a projection extending toward the base end portion of the plunger at an eccentric position with respect to the rotational axis of the output shaft, the projection supporting a spherical bearing; and the connection member radially extends from the base end portion of the plunger and is slidably received by an inner ring of the spherical bearing, wherein the distance between the eccentric position and the rotational axis of the output shaft is greater than the eccentricity distance.

In the present invention, the rotational axis of the output shaft of the motor is disposed to be offset from and angled with respect to the rotational axis of the plunger. In each operation period of the plunger, the output shaft rotates one turn; and the plunger, which receives the rotation of the output shaft via the transmission mechanism, rotates one turn and reciprocates through one cycle in order to effect intake and discharge of ink. In the operation period, the angular displacement of the output shaft corresponding to the intake stroke of the plunger is smaller than the angular displacement of the output shaft corresponding to the discharge stroke of the plunger, whereby intake of ink is completed quickly, and ink is discharged slowly at a substantially constant rate. Therefore, the following effects are achieved.

(1) The intake stage in which no ink is supplied to the inking unit becomes shorter, and the discharge stage in which ink is supplied to the inking unit becomes longer. Further, ink can be discharged at a substantially constant rate. Therefore, variation in ink density on the surface of printed paper can be eliminated in order to improve print quality.

(2) Since in the discharge stage the plunger can be operated slowly as compared with the intake stage, the discharge pressure of ink can be reduced to a low level as compared to conventional pumps, and leakage of ink from a clearance between the cylinder and the plunger can be prevented. As a result, it becomes possible to eliminate adhesion of ink to the outer circumferential surface of the plunger and the transmission mechanism to thereby secure smooth operation. Therefore, the frequency of malfunctions decreases, and the frequency of cleaning can be reduced. Accordingly, maintenance work is facilitated considerably.

(3) Since the discharge pressure of ink is reduced, ink does not leak and does not adhere to the plunger, and the torque required to move the plunger becomes smaller, thereby enabling reduction in size of the motor and energy savings.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE PREFERRED EMBODIMENTS

A pump P for a printing press according to an embodiment of the present invention will now be described with reference to the drawings.

Figure 1:
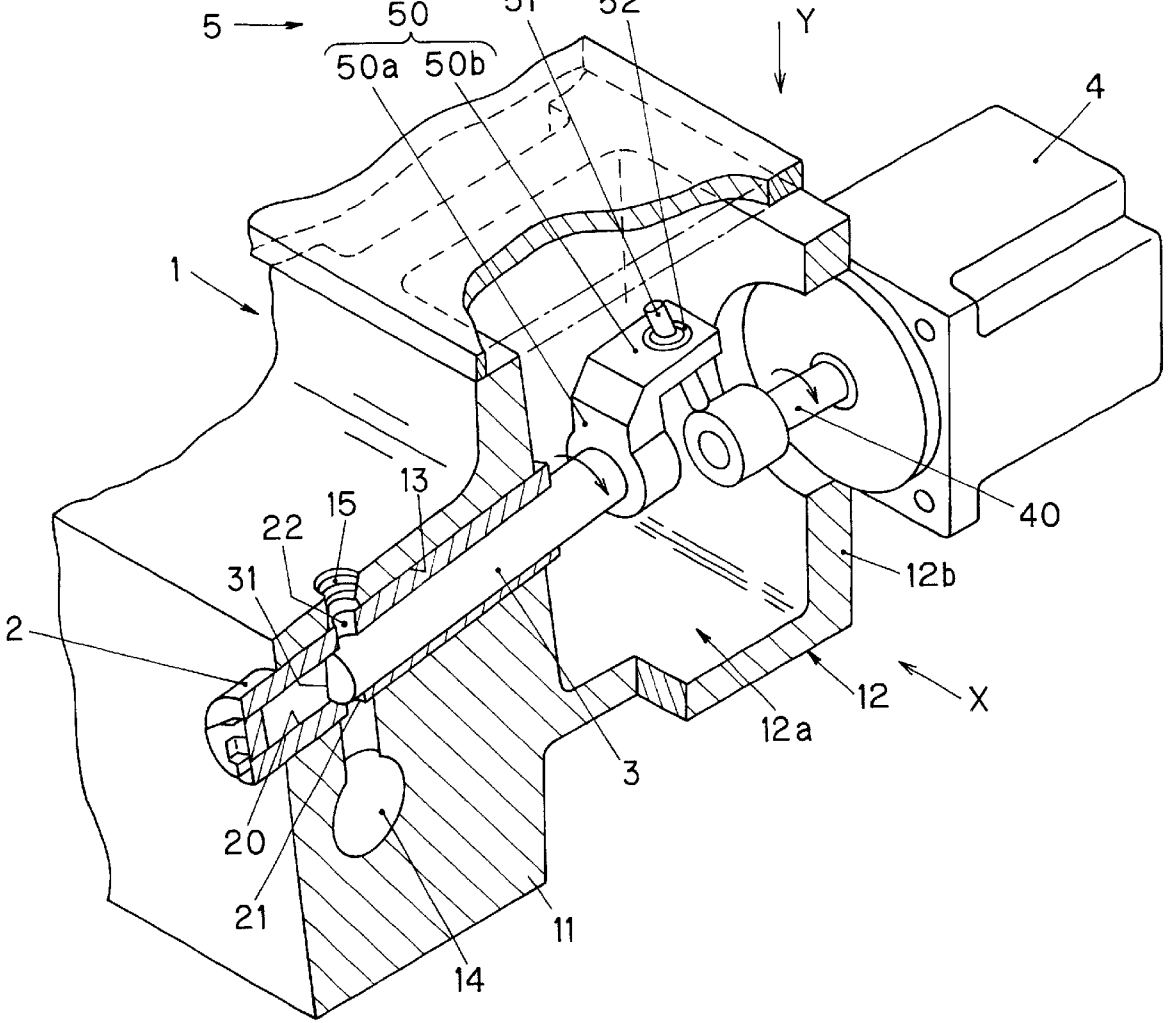
FIG. 1 is a partially sectioned perspective view of a pump according to a first embodiment of the present invention.

As shown in FIG. 1, the pump P includes a body 1, a cylinder 2, a plunger 3, a motor 4, and a transmission mechanism 5. The body 1 is formed by a block portion 11 and a hollow housing portion 12 connected to the block portion 11. The cylinder 2 is fitted into a through hole 13 of the block portion 11 in such a manner that its outer end projects from the outer side surface of the block portion 11, and its inner end reaches a hollow space 12*a* formed inside the hollow housing portion 12. The plunger 3 is accommodated within a main bore 20 of the cylinder 2 to be rotatable and receiprocatable along the axial direction. A base end portion of the plunger 3 projects into the hollow space 12*a* of the hollow housing portion 12. The motor 4 is attached to an outer wall 12*b* of the hollow housing portion 12 in such a manner that an output shaft 40 of the motor 4 projects into the hollow space 12*a* of the hollow housing portion 12. The transmission mechanism 5 is disposed in the hollow space 12*a* in order to connect the output shaft 40 to the plunger 3, to thereby transmit rotation of the output shaft 40 to the plunger 3 while converting the rotational motion of the output shaft 40 to rotation and reciprocative motion of the plunger 3.

The through hole 13 of the block portion 11 for receiving the cylinder 2 is formed to extend from the side of the hollow housing portion 12 toward the outer side surface of the block portion 11, while inclining downward at a certain inclination angle θ. Accordingly, the cylinder 2 also inclines downward at the same inclination angle.

An outer open end of the main bore 20 of the cylinder 2 is closed by means of a plug. At an axial position which is a predetermined distance away from the outer end of the cylinder 2, an intake hole 21 and a discharge hole 22 are formed in the cylinder 2 at diametrically opposite positions such that the intake hole 21 and the discharge hole 22 penetrate the cylinder 2 upward and downward, respectively, along a common center axis. In other words, the intake hole 21 and the discharge hole 22 are opened to the main bore 20 with a phase difference of 180° therebetween; and a plane including the center axes of the intake hole 21 and the discharge hole 22 and the center axis of the main bore 20 coincides with a second imaginary plane C2, which will be described later.

A distal-end portion of the plunger 3, which is accommodated within the main bore 20 to be rotatable and receiprocatable along the axial direction, has a cutaway portion 31. The cutaway portion 31 is formed through removal of a portion having a substantially semicircular cross section and extends axially over a predetermined distance from the distal end surface.

Specifically, the cutaway portion 31 has a length such that the base end of the cutaway portion 31 is located on the side toward the open end of the main bore 20 with respect to the intake hole 21 and the discharge hole 22, when the plunger 3 is moved to the deepest point within the main bore 20, as will be described later.

More specifically, the cutaway portion 31 is formed in such a manner that, when the plunger 3 is moved to the deepest point within the main bore 20 in the course of its reciprocating movement to be described later, the base end of the cutaway portion 31 is located at a position which is offset toward the open end of the main bore 20 with respect to axial positions at which the intake hole 21 and the discharge hole 22 communicate with the main bore 20, respectively, and a cylindrical surface of the plunger 30 can close the intake hole 21 and the discharge hole 22 simultaneously when a flat surface portion of the cutaway portion 31 is parallel to the second imaginary plane C2, which will be described later; and that the distal end of the plunger 3 is located between the plugged end of the main bore 20 and the points at which the intake hole 21 and the discharge hole 22 communicate with the main bore 20, respectively. Therefore, upon rotation of the plunger 3, the intake hole 21 and the discharge hole 22 are closed simultaneously by the cutaway portion 31 at phase angles having an angular difference of 180° therebetween, and only one of the intake hole 21 and the discharge hole 22 is closed by the cutaway portion 31 at other phase angles.

Figure 2:
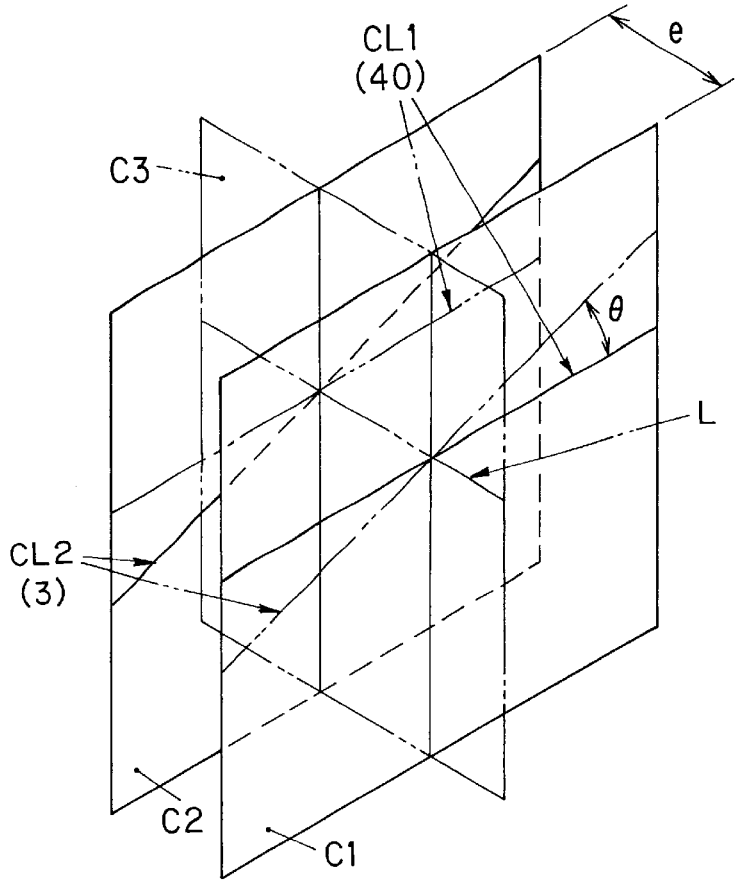
FIG. 2 is an explanatory view showing that the rotational axes of the output shaft of the motor and the plunger shown in FIG. 1 are offset from each other and form an angle therebetween.

The cylinder 2 and the motor 4 are disposed in such a manner that the rotational axis CL1 of the output shaft 40 and the rotational axis CL2 of the plunger 3 have the relationship as shown in FIG. 2.

A first imaginary plane C1 that includes the rotational axis CL1, and the second imaginary plane C2 that includes rotational axis CL2 are parallel to each other and spaced apart from each other by a distance e (hereinafter referred to as an "eccentricity amount e"). The rotational axis CL2 of the plunger 3, which is fitted into the main bore 20 formed to extend from the side of the hollow housing portion 12 toward the outer side surface of the block portion 11, while inclining downward at a certain inclination angle θ, three-dimensionally Intersects the horizontal rotational axis CL1 at an intersecting angle θ.

That is, when one of the first and second imaginary planes C1 and C2 is moved by the eccentricity amount e along a line perpendicular to the imaginary planes C1 and C2 and is superposed on the other plane, the rotational axis CL1 of the output shaft 40 intersects the rotational axis CL2 of the plunger 3 at an intersecting angle θ. The output shaft 40 of the motor 4 and the plunger 3 are connected to each other by means of the transmission mechanism 5.

Moreover, fluid passages 14 and 15 communicating with the intake hole 21 and the discharge hole 22, respectively, of the cylinder 2 are formed in the block portion 11.

The fluid passage 14 is connected to an unillustrated ink supply source. The fluid passage 15 is connected to an inking unit of a printing press.

When the plunger 3 moves in such a manner that its base end portion projects into the hollow space 12*a*, ink is supplied to the main bore 20 of the cylinder 2 via the intake hole 21. When the plunger 3 moves in such a manner that its distal end moves toward the deepest point of the main bore 20, ink is fed from the main bore 20 to the inking unit via the discharge hole 22.

Next, the transmission mechanism 5, which connects the output shaft 40 of the motor 4 to the plunger 3, will be described.

The transmission mechanism 5 includes an arm 50 and a connection member 51, which are attached to the plunger 3 and the output shaft 40, respectively, and which are connected with each other at an eccentric position in such manner that the arm 50 and the connection member 51 can move relative to each other in the radial direction and can change the intersecting angle therebetween.

The arm 50 is formed to have a generally L-like shape and include a radial arm portion 50*a* having a boss at its base end, and an axial arm portion 50*b* having a spherical bearing 52 at its distal end. The connection member 51 is formed of a round rod having a boss at its base end. The distal end of the connection member 51 is fitted into the inner ring of the spherical bearing 52 to be movable in the axial direction of the connection member 51.

Figure 4:
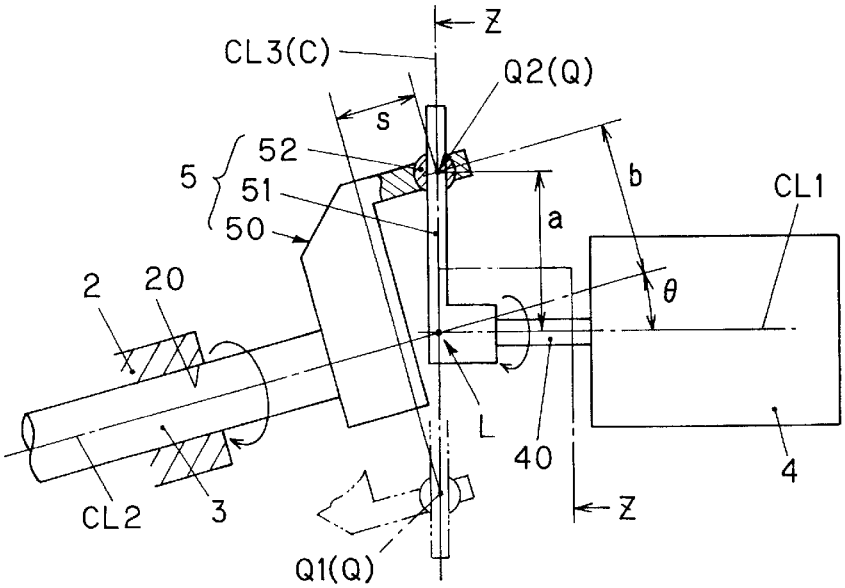
FIG. 4 is a partially sectioned view as viewed in the direction of arrow X in FIG. 1 showing the relationship among the output shaft, the plunger, and the transmission mechanism.

As shown in FIGS. 1 and 4, in the pump P according to the first embodiment of the present invention, the boss of the arm 50 is fitted onto the base end portion of the plunger 3 projecting into the hollow space 12*a*; and the boss of the connection member 51 is fitted onto the tip end portion of the output shaft 40 of the motor 4 projecting into the hollow space 12*a*. Thus, the axial arm portion 50*b* of the arm 50 extends in parallel to the plunger 3 from the distal end of the radial arm portion 50*a* (i.e., at a position eccentric from the rotational axis of the plunger 3); and the connection member 51 projects radially from the output shaft 40.

Figure 3:
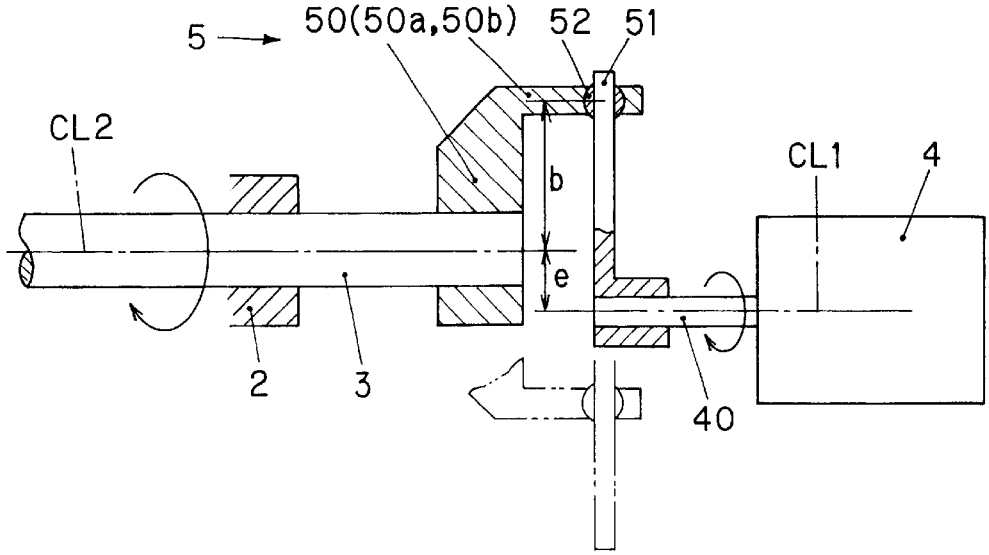
FIG. 3 is a partially sectioned view as viewed in the direction of arrow Y in FIG. 1 showing the horizontally positioned arm and connection member of a transmission mechanism of the pump and showing that the rotational axis of the output shaft of the motor is spaced a predetermined distance from the rotational axis of the plunger.

The above-described eccentricity amount or distance e is set to a value smaller than the effective arm length b of the radial arm portion 50; i.e., the distance between the rotational axis of the plunger 3 and the center of the inner ring of the spherical bearing 52 (hereinafter referred to as an "acting point Q") (see FIG. 3).

As shown in FIGS. 2 and 4, when the connection member 51 attached to the output shaft 40 revolves therearound upon drive of the motor 4, the center axis CL3 of the connection member 51 rotates within an imaginary plane C3. This imaginary plane C3 includes a line L perpendicular to the rotational axis CL1 of the output shaft 40 and the rotational axis CL2 of the plunger 3, which inclines at the intersecting angle θ relative to the rotational axis CL1 of the output shaft 40.

Figure 5:
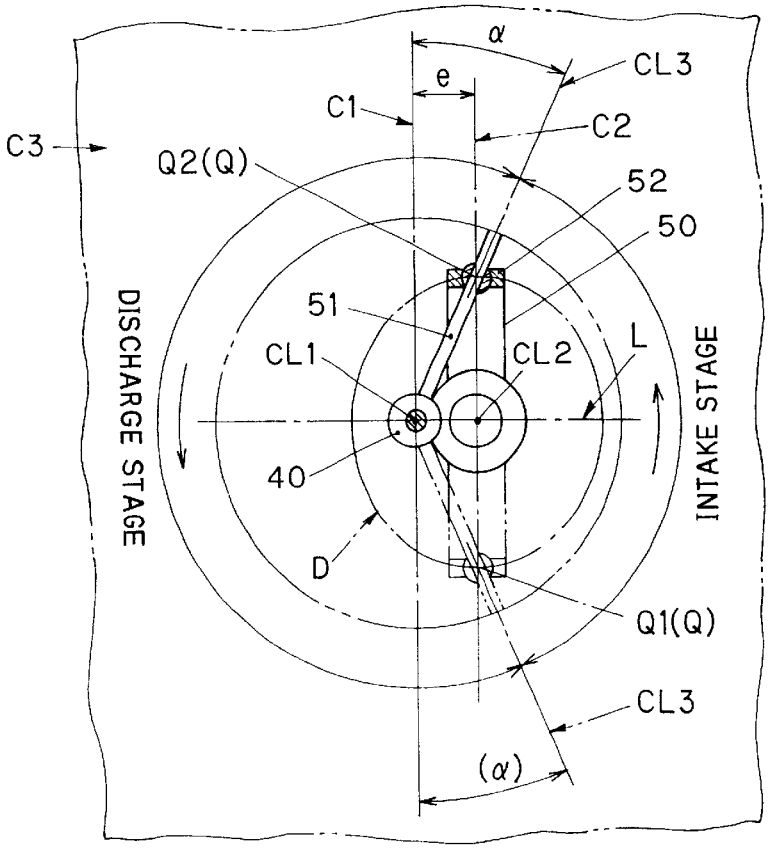
FIG. 5 is a cross-sectional view taken along line Z—Z in FIG. 4 showing angular displacement of the connection member attached to the output shaft of the motor and rotational motion of the arm attached to the plunger and driven by the connection member.

In the pump P having the above-described structure, when the connection member 51 revolves around the center axis CL3 upon rotation of the output shaft 40, as shown in FIG. 5, the acting point Q moves while tracing an ellipse on the third imaginary plane C3. The component of revolution of the acting point Q along the rotational axis CL2 is represented by D. Therefore, due to the revolution of the acting point Q, the plunger 3 moves along the rotational axis CL2 over the stroke S via the arm 50.

Here, the position of the acting point Q at the time when the plunger 3 has moved toward the closed end of the main bore 20 and reached the end point to thereby end the ink discharge stage is called a discharge stage end point (or an intake stage start point) Q1; and the position of the acting point Q at the time when the plunger 3 has moved toward the open end of the main bore 20 and reached the end point to thereby end the ink intake stage is called an intake stage end point (or a discharge stage start point) Q2. As shown in FIGS. 3 and 5, when the spherical bearing 52 is located at the discharge stage end point Q1 or the intake stage end point Q2, the center axis CL3 of the connection member 51 fitted into the inner ring of the spherical bearing 52 is positioned at an angular position which is offset by a from the line formed by intersection of the first imaginary plane C1 and the third imaginary plane C3.

Accordingly, when the counterclockwise rotation (in FIG. 5) of the output shaft 40 of the motor 4 is transmitted to the plunger 3 via the transmission mechanism 5 in order to cause the plunger 3 to rotate one turn and reciprocate through one cycle, during the intake stage (during which the acting point Q moves from the discharge stage end point Q1 to the intake stage end point Q2), the center axis CL3 of the connection member 51 revolves by an angle of $180°-2\alpha$; and during the discharge stage (during which the acting point Q moves from the intake stage end point Q2 to the discharge stage end point Q1), the center axis CL3 of the connection member 51 revolves by an angle of $180°+2\alpha$.

As a result, through appropriate selection of the eccentricity amount e within the ellipse D on the third imaginary plane C3, the angular regions of the output shaft 40 for the intake and discharge stages can be set in such a manner that the angular region corresponding to the intake stage is narrowed so as to move the plunger 3 quickly in the intake stage and that the angular region corresponding to the discharge stage is widened so as to move the plunger 3 slowly in the discharge stage.

Figure 7:
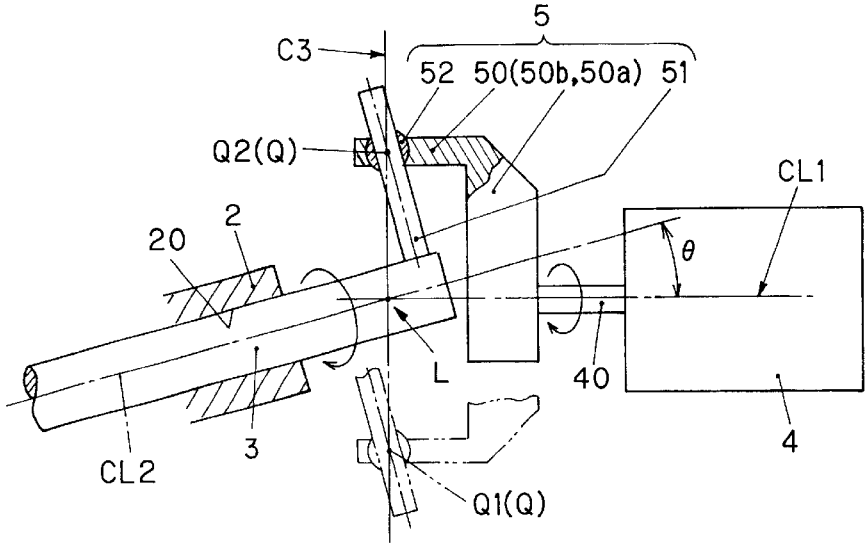
FIG. 7 is a partially sectioned view similar to that of FIG. 4, showing the relationship among the output shaft, the plunger, and the transmission mechanism of a pump for a printing press according to a second embodiment of the present invention.
Figure 8:
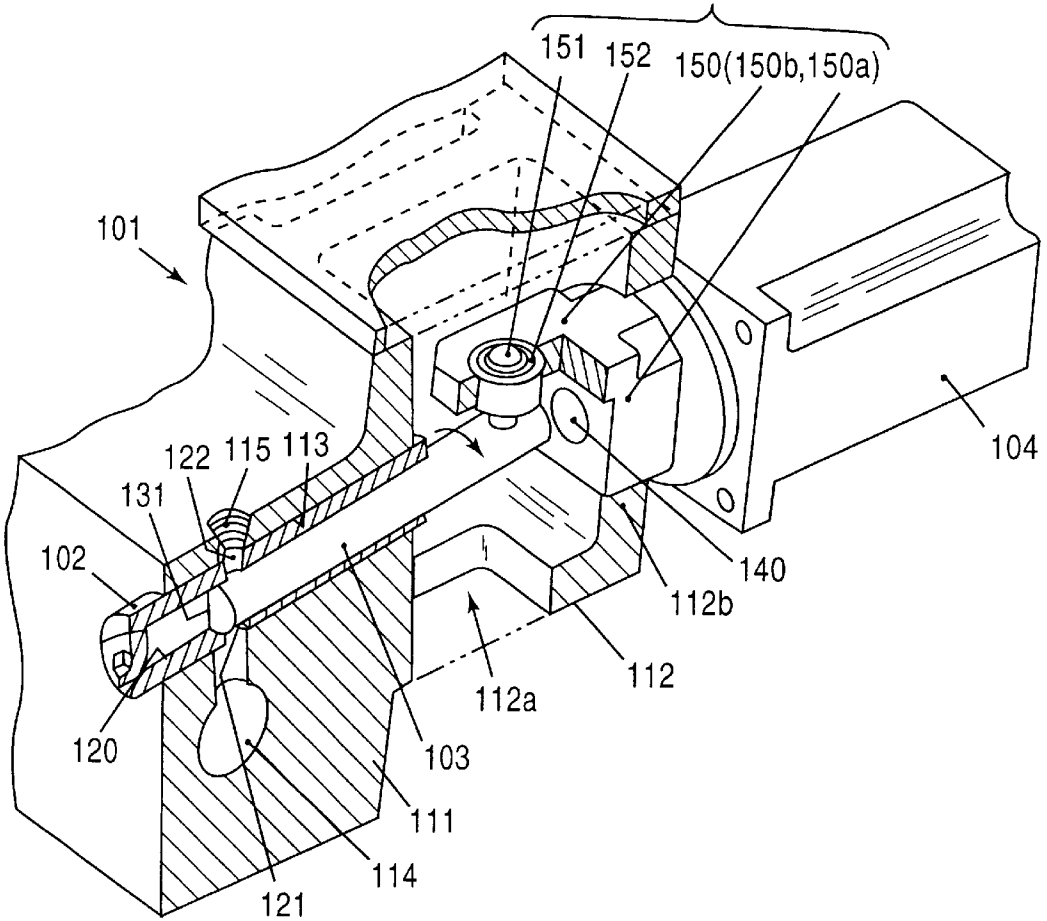
FIG .8 PRIOR ART
FIG. 8 is a partially sectioned perspective view of a conventional pump.

FIG. 7 shows a pump P for a printing press according to a second embodiment of the present invention. In contrast to the pump P of the first embodiment, the boss of the connection member 51 is fitted onto the base end portion of the plunger 3 projecting into the hollow space 12*a*; and the boss of the arm 50 is fitted onto the tip end portion of the output shaft 40 of the motor 4 projecting into the hollow space 12*a*.

In other words, the pump P of the second embodiment shown in FIG. 7 has a structure obtained through mutual exchange of the connection member 51 attached to the output shaft 40 and the arm 50 attached to the base end portion of the plunger 3 in the transmission mechanism 5 according to the first embodiment shown in FIG. 4. Except for this difference, the second embodiment is substantially identical with the first embodiment in terms of structure and operation to be described later. Therefore, description of the pump P according to the second embodiment is omitted.

Next, operation of the pump P according to the first embodiment will be described with reference to FIGS. 3, 4, 5, and 6.

FIGS. 1 and 4 show a state in which the center of the spherical bearing 52 of the arm 50 has been located at the intake stage end point Q2 through retraction of the plunger 3 toward the open end of the main bore 20. When the motor shaft 40 rotates about the rotational axis CL1 in the direction indicated by an arrow in this state, the plunger 3 moves toward the closed end of the main bore 20 while rotating about the rotational axis CL2. As a result, ink is discharged.

When the pump P having been in the discharge stage ends the discharge stage, the discharge hole 22 which has been opened due to the presence of the cutaway portion 31 of the plunger 3 is closed by the circumferential surface of the plunger 3; and the spherical bearing 52 reaches the discharge stage end point Q1.

When the spherical bearing 52 has passed through the discharge stage end point Q1, the pump P enters the intake stage. In the intake stage, of the intake hole 21 and the discharge hole 22 having been closed by the plunger 3, the intake hole 21 is opened due to presence of the cutaway portion 31 of the rotating plunger 3. Thus, intake of ink starts.

The plunger 3 continues its rotation and moves toward the hollow space 12*a* to thereby take in ink. Simultaneous with completion of the intake stage, the intake hole 21 which has been opened due to the presence of the cutaway portion 31 of the plunger 3 is closed by the circumferential surface of the plunger 3; and the spherical bearing 52 reaches the intake stage end point Q2.

Since the rotational axis CL1 of the output shaft 40 is disposed at an angle with and eccentric to the rotational axis CL2 of the plunger 3 as shown in FIG. 2, at the discharge stage end point Q1 and the intake stage end point Q2, the center axis CL3 of the connection member 51 slidably fitted into the inner ring of the spherical bearing 52 intersects, at an angle a, the intersection line formed between the first imaginary plane C1 and the third imaginary plane C3 (see FIG. 5).

Therefore, during a period in which the connection member 51 rotates the plunger 3 by 180° in the intake stage, the output shaft 40 rotates over an angle of $180°-2\alpha$. On the other hand, during a period in which the connection member 51 rotates the plunger 3 by 180° in the discharge stage, the output shaft 40 rotates over an angle of $180°+2\alpha$.

In other words, when the motor 40 rotates at a constant speed, the connection member 51 attached to the output shaft 40 revolves at a constant speed. Therefore, the ratio of the discharge stage to the operation cycle of the plunger 3 increases, so that the discharge is effected slowly over a prolonged period of time. Meanwhile, the ratio of the intake stage to the operation cycle of the plunger 3 decreases, so that the intake is completed quickly.

The angular displacement of the plunger 3, which rotates upon constant angular displacement of the connection member 51, will be described with reference to FIGS. 5 and 6.

Figure 6:
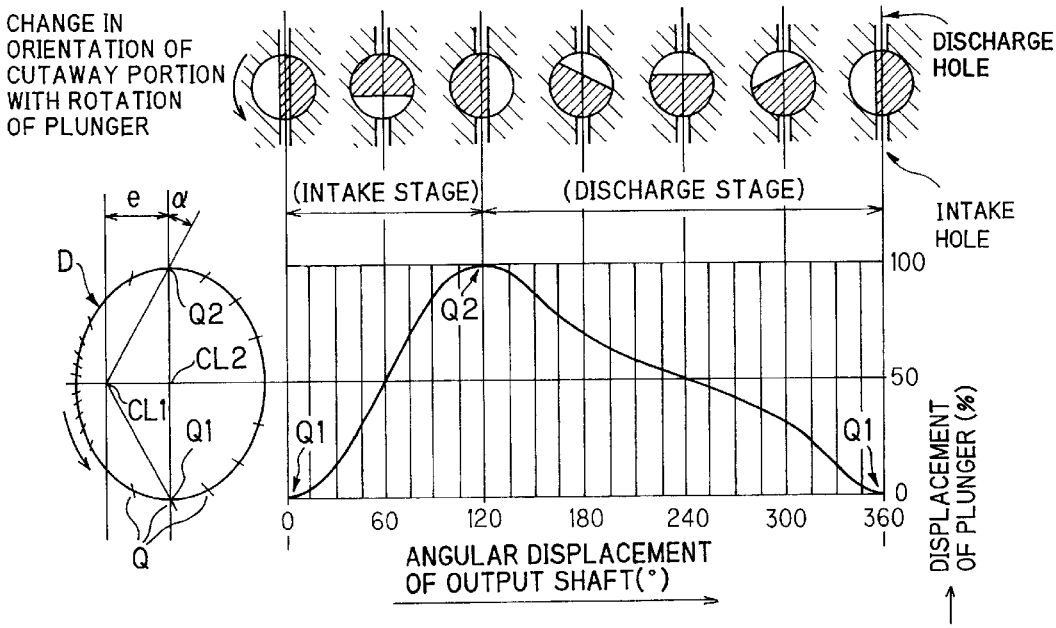
FIG. 6 is a graph showing the operation cycle of the plunger and the axial displacement of the plunger, with angular displacement of the output shaft being used as a reference, for the case in which the transmission mechanism shown in FIG. 4 operates in accordance with the relationship shown in FIG. 5.

FIG. 6 is a graph showing the operation cycle of the plunger 3 and the axial displacement of the plunger 3, with angular displacement of the output shaft 40 being used as a reference, for the case in which the transmission mechanism 5 shown in FIG. 4 operates in accordance with the relationship shown in FIG. 5. The horizontal axis represents the angular displacement of the output shaft (unit: degree); and the vertical axis represents displacement of the plunger (unit: percentage).

In the intake stage; i.e., during a period in which the acting point Q moves from the discharge stage end point (the intake stage start point) Q1 to the intake stage end point Q2, the output shaft 40 rotates over $180°-2\alpha$, and the arm 50 driven by the connection member 51 fixed to the output shaft 40 rotates over 180° to end the intake stage. The amount of angular displacement of the plunger 3 (i.e., the amount of angular displacement of the acting point Q) in the intake stage is made greater than the amount of angular displacement of the output shaft 40, by means of the connection member 51.

In other words, the acting point Q, which is angularly displaced by the connection member 51 attached to the rotating output shaft 40, moves parallel to the center axis CL3 of the connection member 51, as the pump P approaches a" midpoint of the intake stage, and gradually moves away from the rotational axis of the output shaft 40. Therefore, the angular displacement of the connection member 51 is transmitted to the arm 50 at a position relatively remote from the rotational axis of the output shaft 40, so that a relatively large angular displacement as compared with the angular displacement of the output shaft 40 is imparted to the plunger 3.

In the intake stage, when the acting point Q has passed through the discharge stage end point Q1; i.e., the intake stage start point, the plunger 3 moves toward the hollow space 12*a* so as to take in ink. The operation speed reaches the maximum at a midpoint of the intake stage. Subsequently, the acting point Q reaches the intake stage end point Q2.

Meanwhile, in the discharge stage; i.e., during a period in which the acting point Q moves from the intake stage end point (discharge stage start point) Q2 to the discharge stage end point Q1, the output shaft 40 rotates over $180°+2\alpha$, and the arm 50 driven by the connection member 51 fixed to the output shaft 40 rotates over 180° to end the discharge stage. The amount of angular displacement of the plunger 3 (i.e., the amount of angular displacement of the acting point Q) in the discharge stage is made smaller than the amount of angular displacement of the output shaft 40, by means of the connection member 51.

In the vicinity of the intake stage end point Q2 and the discharge stage end point Q1, the acting point Q undergoes angular displacement at a speed similar to the angular displacement speed of the connection member 51. However, when the acting point Q has left these points, the angular displacement speed of the acting point Q decreases toward the midpoint of the corresponding stage, and a considerably constant angular displacement speed is maintained over a wide, intermediate region in the discharge stage.

In the first half of the discharge stage, the acting point Q moves parallel to the center axis CL3 of the connection member 51 to gradually approach the rotational axis of the output shaft 40. Therefore, the angular displacement of the connection member 51 is transmitted to the arm 50 at a position relatively close to the rotational axis of the output shaft 40, so that the acting point Q moves slowly (see FIG. 6). Therefore, as indicated by the displacement curve of FIG. 6, the plunger 3 moves slowly at a substantially constant speed in order to discharge ink at a substantially constant rate.

In the wide intermediate range of the discharge stage, as shown in FIGS. 5 and 6, the connection member 51, rotated by the motor 4 at a constant speed, drives the arm 50 via the acting point Q located in the vicinity of the center of angular displacement of the connection member 51, so that a large torque can be transmitted to the plunger 3 in order to cope with a relatively large load generated during discharge. Therefore, a motor of small output torque can be used as the motor 4.

Further, as shown in FIG. 5, when the connection member 51 angularly displaces from the discharge stage end point Q1 toward the intake stage end point Q2, in the region between the discharge stage end point Q1 and the midpoint between these two points, the acting point Q displaces to move away from the center of angular displacement of the connection member 51. Therefore, the circumferential speed at which the acting point Q moves along the ellipse D increases, so that the moving speed of the plunger 3 in the intake stage increases rapidly and reaches a maximum at the midpoint. After passage of the midpoint, contrary to the case described above, the moving speed of the plunger 3 decreases rapidly and becomes zero at the intake stage end point Q2.

Meanwhile, after passage of the intake stage end point Q2, the acting point Q of the spherical bearing 52, driven by the connection member 51 to displace angularly, continues its angular displacement toward the discharge stage end point Q1.

Since the acting point Q changes its position to approach the center of angular displacement of the connection member 51 up to the midpoint, the circumferential speed of the acting point Q decreases, and thus, the speed of angular displacement of the arm 50 decreases, so that the moving speed of the plunger 3 in the discharge stage decreases. The circumferential speed of the acting point Q reaches a minimum at the midpoint, and the reduced moving speed of the plunger 3 is maintained. Therefore, the plunger 3 moves relatively slowly over substantially the entirety of the discharge stage.

That is, in the pump for a printing press according to the embodiment of the present invention, the output shaft 40 and the plunger 3, which are disposed in such a manner that the rotation axis CL1 of the output shaft 40 is angled with respect to the rotational axis CL2 of the plunger 3 and is separated from the axis CL2 by the eccentricity amount e, are connected with each other by means of the transmission mechanism 5. Thus, the angular displacement of the output shaft 40 corresponding to the intake stroke of the plunger 3 can be rendered smaller than the angular displacement of the output shaft 40 corresponding to the discharge stroke of the plunger 3, whereby the ink intake operation can be completed quickly. Moreover, the angular displacement of the output shaft 40 corresponding to the discharge stroke of the plunger 3 can be rendered greater than the angular displacement of the output shaft 40 corresponding to the intake stroke of the plunger 3, whereby the ink can be discharged slowly.

Next, a specific example of the first embodiment will be shown. With reference to FIGS. 2, 3, 4, and 5, there will be described a case in which the ratio of the intake stage to the discharge stage is 0.5; i.e., the angular range of the output shaft 40 for the intake stage is 120° and the angular range of the output shaft for the discharge stage is 240°.

Here, the intersecting angle is represented by θ; the eccentricity amount is represented by e; the arm length of the arm 50 is represented by b; the entire stroke s of the plunger 3 is represented by s; and the distance between the center of the output shaft 40 and the discharge stage end point Q1 is represented by a. When $0<e<b$, the following relationships hold.

$$a=b/\cos\theta$$

$$s/2=b\cdot\tan\theta$$

$$e=a\cdot\tan\alpha=b\cdot\tan\alpha/\cos\theta$$

In a specific case in which b=20 mm, θ=150, and α=30°, e=20·tan 30°/cos 15°=11.95 mm, s=2·20·tan 15°=10.72 mm, and a=20/cos 15°=20.71 mm. Employment of these values enables the discharge stage to be performed slowly over a time double that of the intake stage, and enables ink to be discharged at substantially constant discharge rate in the discharge stage.

Notably, the motor 4 used in the pumps according to the first and second embodiments of the present invention is a variable speed motor. Therefore, through changing of the rotational speed of the motor 4, the operation period of the plunger 3 can be changed in order to change the discharge rate. However, instead of changing the rotational speed of the motor 4, the discharge rate can be changed through use of a constant speed motor 4 and a mechanism (not shown) capable of changing the stroke of the plunger 3 by changing the intersecting angle θ between the rotational axis CL1 of the output shaft 40 of the motor 4 and the rotational axis CL2 of the plunger 30.

The pumps according to the first and second embodiments of the present invention each include a single pump unit. However, needless to say, the present invention can be applied to a pump for a printing press which includes a plurality of pump units arranged in a line, as in the case of pumps generally used in offset printing presses.

Obviously, numerous modifications and variations of the present invention are possible in light of the above teachings. It is therefore to be understood that within the scope of the appended claims, the present invention may be practiced otherwise than as specifically described herein.

What is claimed is:

1. A pump for a printing press comprising:

a cylinder having a main bore which extends along an axis of the cylinder and is closed at one end, and intake and discharge holes which are opened to an inner surface of the cylinder at different circumferential positions;

a plunger fitted into the main bore to be rotatable about the axis and reciprocatable along the axis, the plunger closing the intake and discharge holes simultaneously at certain angular positions and closing only one of the intake and discharge holes at other angular positions;

a motor for rotating and reciprocating the plunger, the motor being disposed in such a manner that an output shaft of the motor faces a base end portion of the plunger projecting from an open end of the cylinder, that a space is present between the base end portion and the output shaft, and that a rotational axis of the output shaft is radially offset, by a certain eccentricity distance, from a rotational axis of the plunger and forms an angle with the rotational axis of the plunger; and a transmission mechanism disposed in the space and including a first member fixed to the base end portion of the plunger, and a second member fixed to the output shaft of the motor, the first and second members being connected with each other at an eccentric position in such manner that the first member and the second member can move relative to each other in the radial direction of the output shaft or the plunger and can change an intersecting angle therebetween.

2. A pump for a printing press according to claim 1, wherein the first member is an arm attached to the base end portion of the plunger, and the second member is a connection member attached to the output shaft of the motor; the arm has a projection extending toward the output shaft of the motor at an eccentric position with respect to the rotational axis of the plunger, the projection supporting a spherical bearing; and the connection member radially extends from the output shaft and is slidably received by an inner ring of the spherical bearing, wherein the distance between the eccentric position and the rotational axis of the plunger is greater than the eccentricity distance.

3. A pump for a printing press according to claim 1, wherein the first member is a connection member attached to the base end portion of the plunger, and the second member is an arm attached to the output shaft of the motor; the arm has a projection extending toward the base end portion of the plunger at an eccentric position with respect to the rotational axis of the output shaft, the projection supporting a spherical bearing; and the connection member radially extends from the base end portion of the plunger and is slidably received by an inner ring of the spherical bearing, wherein the distance between the eccentric position and the rotational axis of the output shaft is greater than the eccentricity distance.

* * * * *